US006146201A

United States Patent [19]

Chen

[11] Patent Number: 6,146,201

[45] Date of Patent: Nov. 14, 2000

[54] ELECTRICAL CONNECTOR HAVING A REAR SHIELDING MEMBER SHIELDING TAIL SECTIONS OF CONTACT ELEMENTS OF THE CONNECTOR

[75] Inventor: Chao-Hsu Chen, Chia-I, Taiwan

[73] Assignee: Hon Hai Precision Ind. Co., Ltd., Taipei Hsien, Taiwan

[21] Appl. No.: 09/330,895

[22] Filed: Jun. 11, 1999

[30] Foreign Application Priority Data

Dec. 1, 1998 [TW] Taiwan ..... 87220010

[51] Int. Cl.[7] ..... H01R 13/648

[52] U.S. Cl. ..... 439/607

[58] Field of Search ..... 439/607, 79, 80

[56] References Cited

U.S. PATENT DOCUMENTS 5,137,472 8/1992 Hillbish et al. ..... 439/607
5,639,267 6/1997 Loudermilk ..... 439/607
5,980,272 11/1999 McHugh et al. ..... 439/79

*Primary Examiner*—Neil Abrams
*Assistant Examiner*—Javaid Nasri
*Attorney, Agent, or Firm*—Wei Te Chung

[57] ABSTRACT

An electrical connector includes an insulative housing having a front face and an opposite rear face. A plurality of passageways are defined in the housing between the front and rear faces for receiving and retaining contact elements. Each contact element has a mating section extending beyond the front face and a tail section extending beyond the rear face. A front shielding member is attached to the front face of the housing. The front shielding member has a tubular section surrounding and shielding the mating sections of the contact elements. A rear shielding member is attached to the rear face of the housing and shields the tail sections of the contact elements. The rear shielding member includes a plate having an edge received in a slot defined in the rear face of the housing. Notches are formed in the edge of the plate into which projections having expanded ends formed in the slot of the housing are fittingly received thereby securing the plate to the housing.

5 Claims, 6 Drawing Sheets

ELECTRICAL CONNECTOR HAVING A REAR SHIELDING MEMBER SHIELDING TAIL SECTIONS OF CONTACT ELEMENTS OF THE CONNECTOR

BACKGROUND OF THE INVENTION

1. Field of the Invention

The present invention generally relates to an electrical connector, and in particular to an electrical connector having excellent shielding properties.

2. The Prior Art

An electrical connector mounted on a circuit board for mating with a connector fixed on an end of a cable to establish electrical connection therebetween is well known in the electronics field. Examples are disclosed in Taiwan Patent Application Nos. 84207642 and 86212787. FIG. 5 of the attached drawings shows an example of a conventional connector. A connector 5 comprises an insulative housing 51 having a front face with two tongue plates 52 extending therefrom. Each tongue plate 52 has opposite faces with passageways defined therein for each receiving a mating section 62 of a contact element 61. Each contact element 61 has a tail section 63 extending through the housing 51 and projecting beyond a rear face thereof. A shielding member 71 comprises a tubular section 73 extending from a surrounding flange 72 and defining a cavity 75. The flange 72 is attached to the front face of the housing 51 with the cavity 75 of the tubular section 73 receiving and shielding the tongue plates 52 and the mating ends 62 of the contact elements 61. Lugs 74 are formed on edges of the flange 72. Each defines a hole 76 for engaging with a barb 53 formed on the housing 51 to fix the shielding member 71 to the housing 51.

The shielding member 71 shields and protects the mating sections 62 of the contact elements 61 from external electromagnetic interference (EMI) and undesired mechanical loads. However, the tail sections 63 of the contact elements 61 are exposed and unshielded whereby protection from damage incurred thereon by a foreign object is not provided and a short circuit may result. In addition, the exposed tail sections of the contact elements are subject to external electromagnetic interference thereby adversely affecting signal transmission therethrough.

It is thus desirable to have an electrical connector having improved shielding properties.

SUMMARY OF THE INVENTION

Accordingly, an object of the present invention is to provide an electrical connector having shielding means to completely shield contact elements thereof.

Another object of the present invention is to provide an electrical connector having shielding members to protect contact elements thereof from being subject to external forces.

A further object of the present invention is to provide an electrical connector having shielding members to protect contact elements thereof from electromagnetic interference.

To achieve the above objects, an electrical connector in accordance with the present invention comprises an insulative housing having a front face and an opposite rear face. A plurality of passageways are defined in the housing between the front and rear faces for receiving and retaining contact elements. Each contact element has a mating section extending beyond the front face and a tail section extending beyond the rear face. A front shielding member is attached to the front face of the housing. The front shielding member has a tubular section surrounding and shielding the mating sections of the contact elements. A rear shielding member is attached to the rear face of the housing and shields the tail sections of the contact elements. The rear shielding member includes a plate having an edge received in a slot defined in the rear face of the housing. Notches are formed in the edge of the plate into which projections having expanded ends formed in the slot of the housing are fittingly received thereby securing the plate to the housing.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1A:
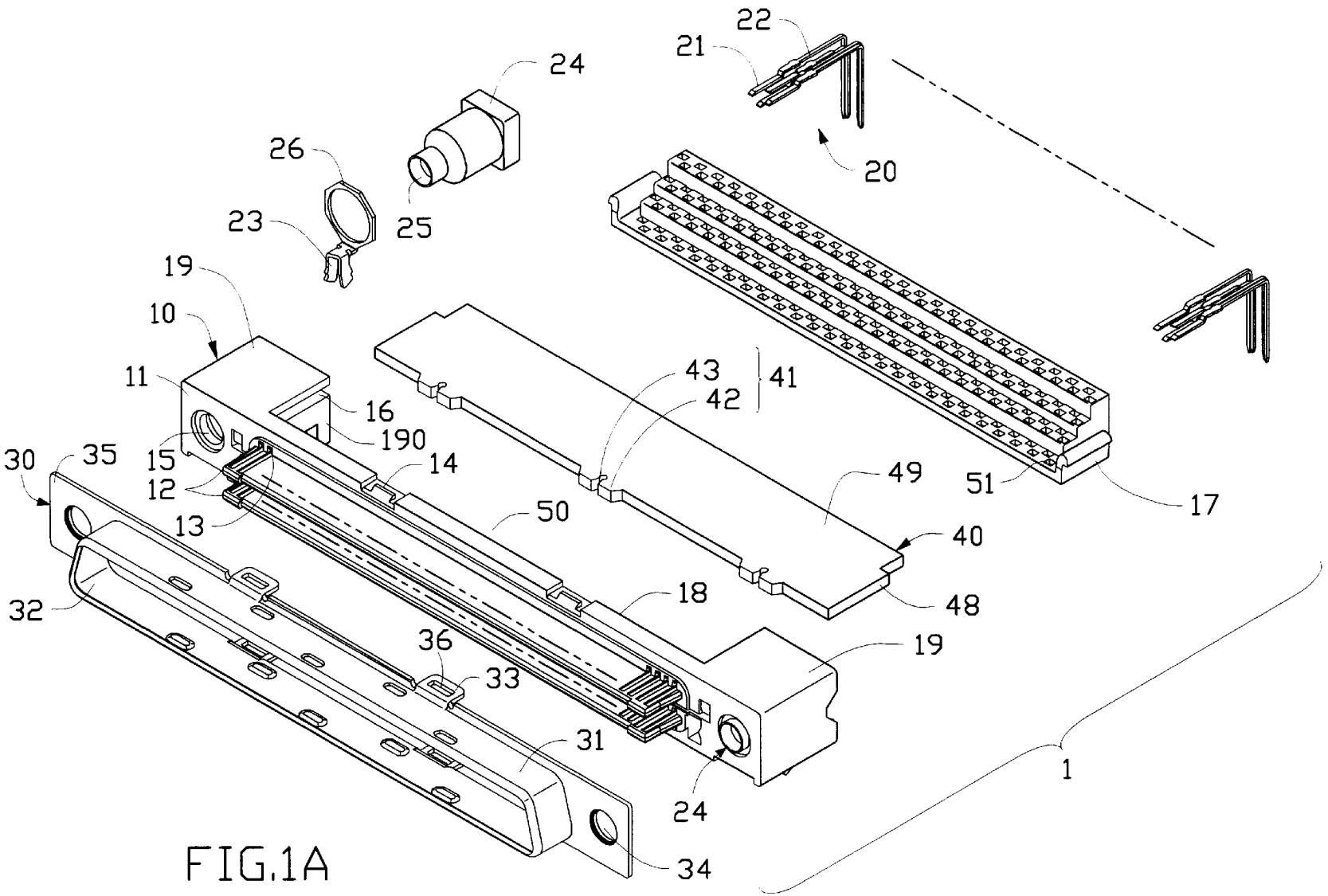
FIG. 1A is an exploded view of an electrical connector constructed in accordance with the present invention.
Figure 2A:
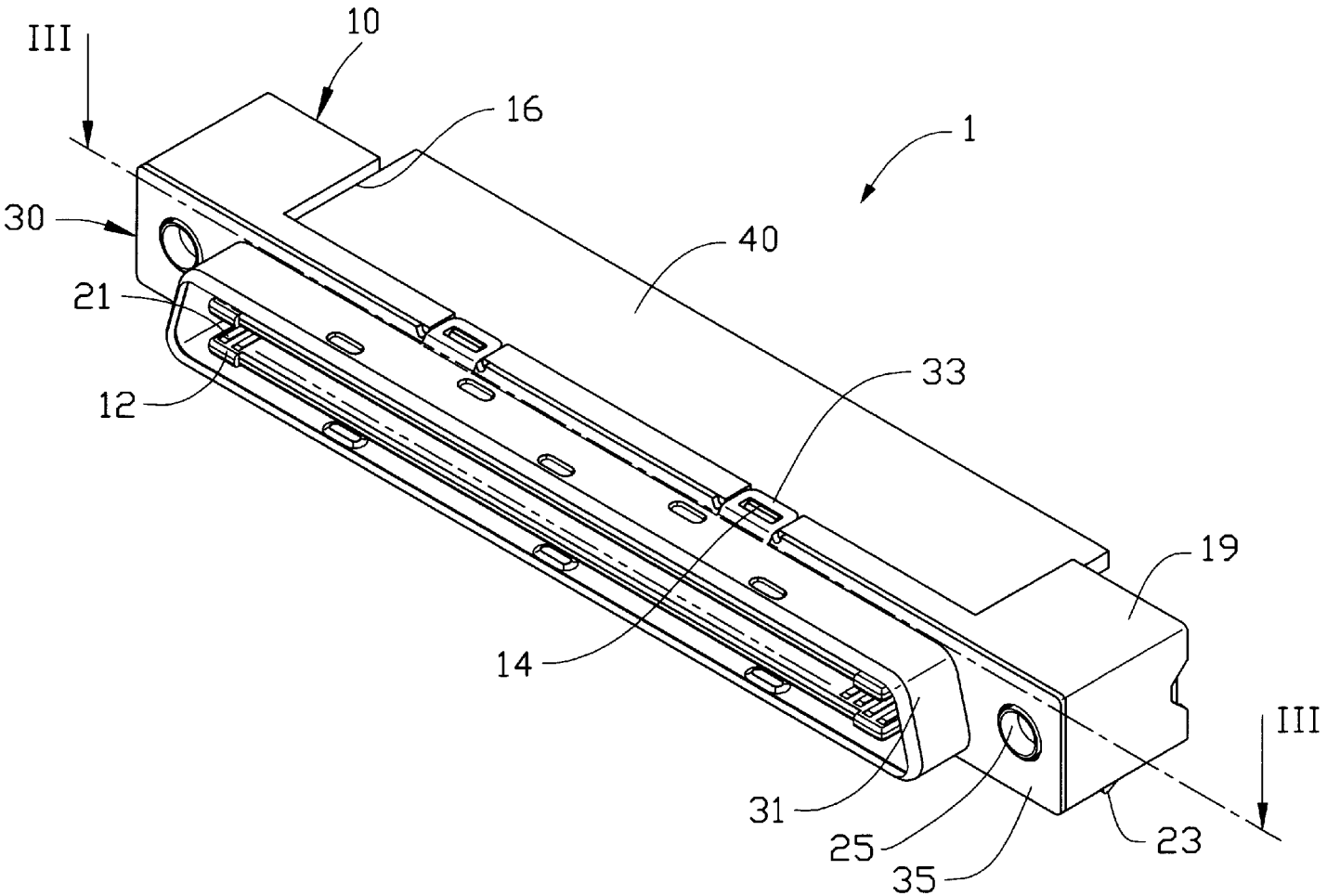
FIG. 2A is an assembled view of FIG. 1A.

Referring to the drawings and in particular to FIGS. 1A and 2A, an electrical connector 1 constructed in accordance with the present invention comprises an insulative housing 10 retaining a number of contact elements 20 therein, a front shielding member 30 and a rear shielding member 40 attached to the housing 10. The housing 10 has a front face 11 from which tongue plates 12 extend and an opposite rear face 18. The housing 10 comprises two end blocks 19 having inside faces 190 opposing each other and defining a space 50 therebetween together with the rear face 18 of the housing 10.

A plurality of passageways 13 is defined in the housing 10 between the front face 11 and the rear face 18 for receiving the contact elements 20 therein. Each contact element 20 has a mating section 21 extending beyond the front face 11 and received in a corresponding groove (not labeled) defined in a surface of the corresponding tongue plate 12 and a tail section 22 extending in an opposite direction beyond the rear face 18 of the housing 10 and located in the space 50 for connecting to a circuit board (not shown).

A spacer 17 is received in the space 50 and fixed to the end blocks 19. The spacer 17 defines a number of holes 51 therein for receiving and retaining the tail sections 22 of the contact elements 20 in position.

The front shielding member 30 comprises a surrounding flange 35 and a tubular section 31 defining a cavity 32 extending from the surrounding flange 35. The flange 35 is attached to the front face 11 of the housing 10 with the tongue plates 12 and the mating sections 21 of the contact elements 20 received in the cavity 32 of the tubular section 31 whereby the tubular section 31 shields and protects the mating sections 21 of the contact elements 20. Lugs 33 are formed on the flange 35 and define holes 36 therein for engaging with barbs 14 formed on the housing 10 thereby securing the front shielding member 30 to the housing 10.

Each end block 19 of the housing 10 defines a bore 15 therein for receiving a fastener 24. The fastener 24 has a free end 25 extending into a hole 34 defined in the flange 35 of the front shielding member 30 to electrically engage therewith. The engagement may be achieved by manually expanding the free end 25 of the fastener 24 or by some other means.

A board lock 23 is engageable with a corresponding hole defined in a circuit board (not shown) for securing the connector 1 to the circuit board. The board lock 23 forms a ring 26 through which each fastener 24 extends for attaching the board lock 23 to the housing 10.

Figure 3:
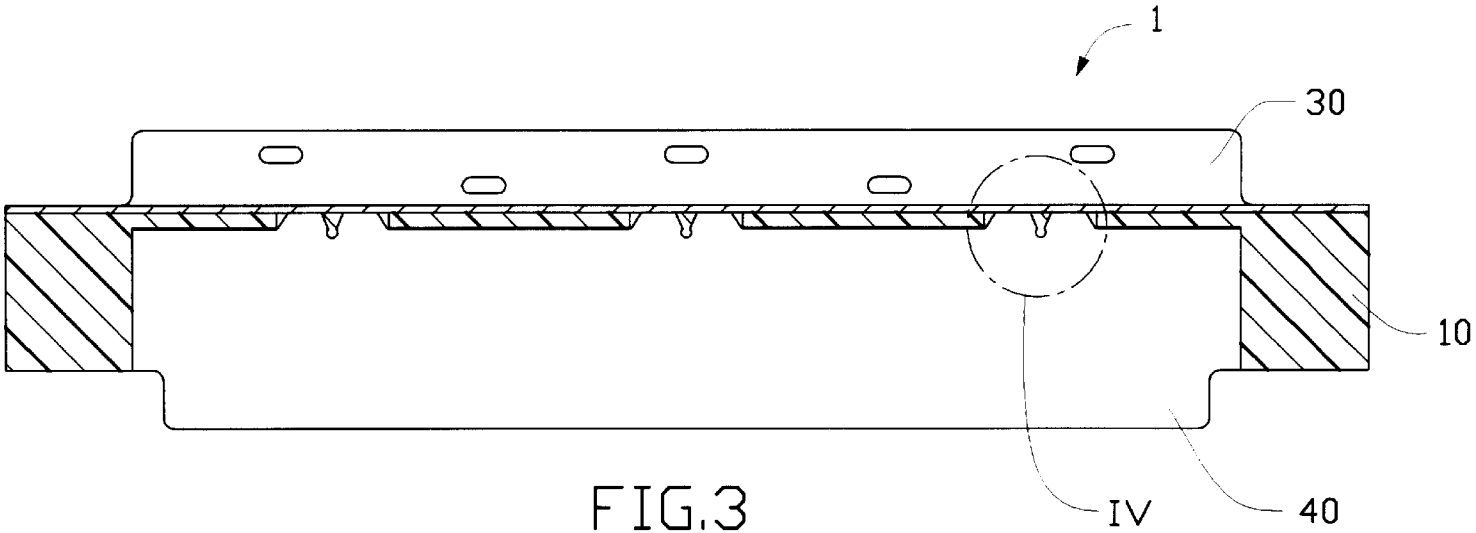
FIG. 3 is a cross-sectional view taken along line III—III of FIG. 2A.

The rear shielding member 40 comprises a plate 49 received in the space 50 defined between the end blocks 19 of the housing 10 (FIGS. 2A and 3) whereby the plate 49 of the rear shielding member 40 substantially shields the tail sections 22 of the contact elements 20 located in the space 50. Thus, the tail sections 22 of the contact elements 20 are protected from being contacted and thus damaged by a foreign object (not shown).

The plate 49 may be made from plastic material. Alternatively, a MYLAR layer may be coated on the plate 49 to provide anti-electrostatic and/or EMI protection properties for protecting the tail sections 22 of the contact elements 20 from being adversely affected by electrostatic or electromagnetic interference.

Figure 1B:
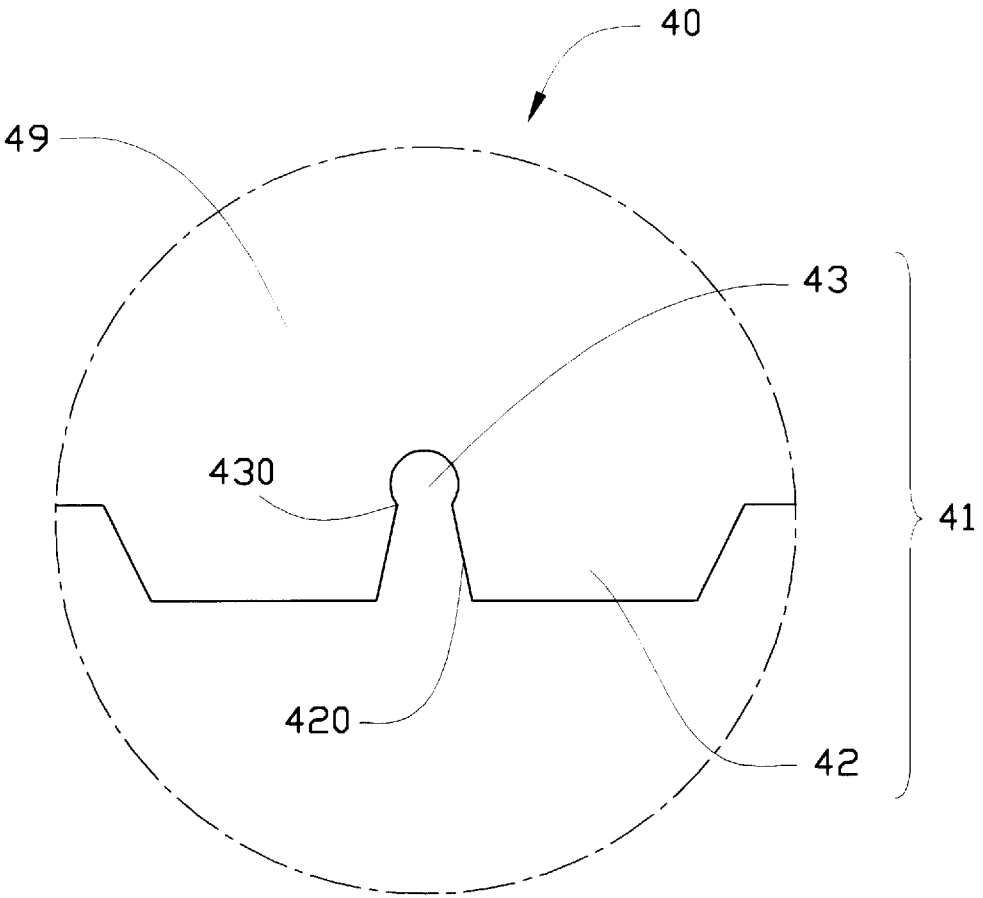
FIG. 1B is an enlarged top view of a portion of a rear shielding member of the connector.
Figure 2B:
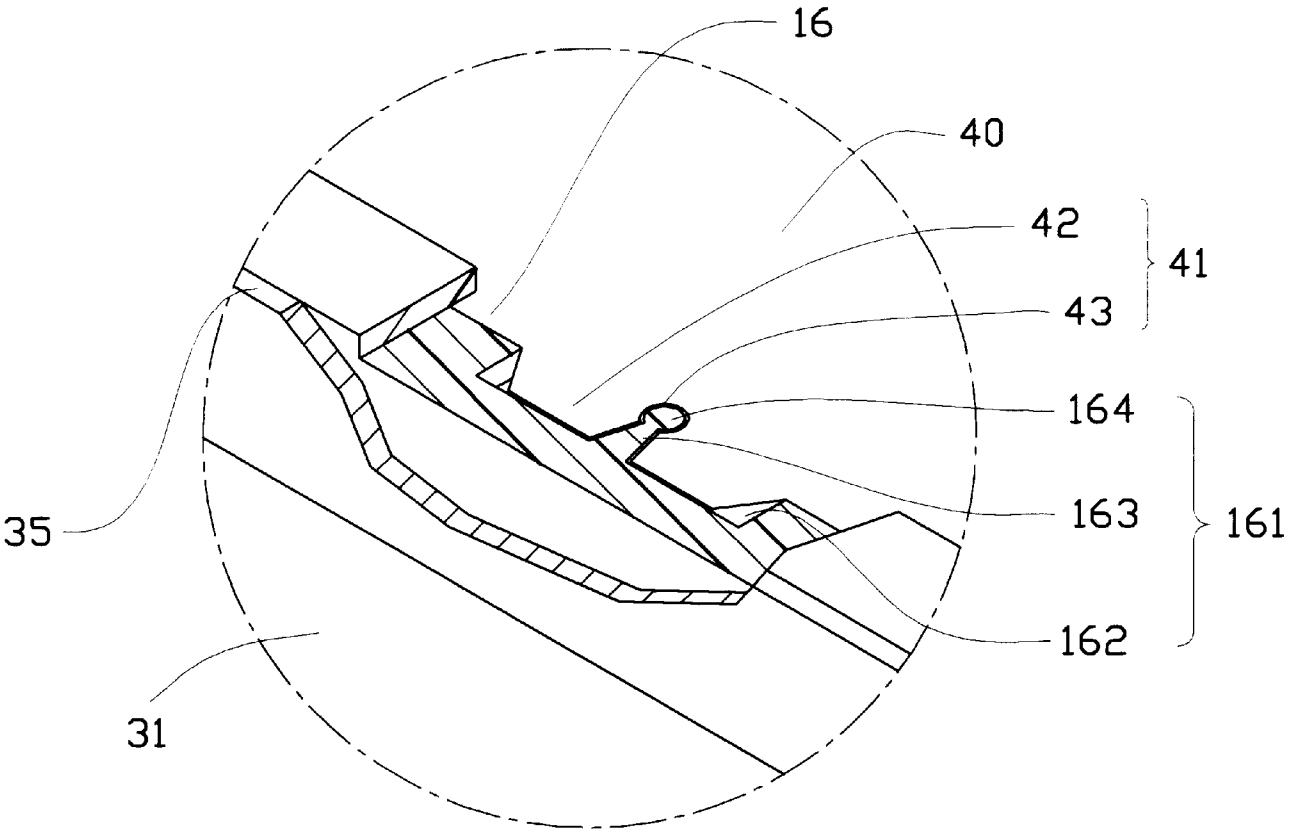
FIG. 2B is an enlarged view of FIG. 2A with a portion thereof being cut away.

The plate 49 has a peripheral edge 48 received in a slot 16 defined in the housing 10 and extending along the inside faces 190 of the end blocks 19 and the rear face 18 of the housing 10. First securing means 41 is provided on the peripheral edge 48 of the plate 49 for engaging with counterpart second securing means 161 (FIG. 2B) formed on the housing 10 to secure the rear shielding member 40 to the housing 10. As particularly shown in FIG. 1B, the first securing means 41 comprises a number of notches 43 formed in the peripheral edge 48. Preferably, each notch 43 is defined between two spaced protrusions 42 having inclined inner faces 420 opposing and diverging away from each other thereby defining a neck 430 between the inner faces 420 and the notch 43.

Figure 4:
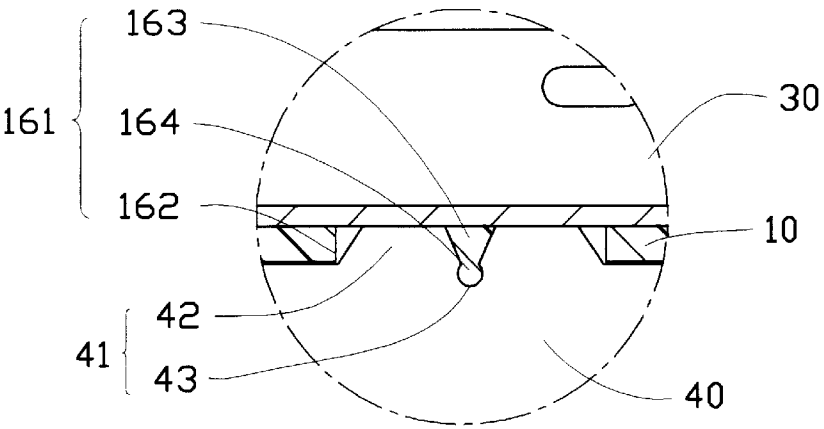
FIG. 4 is an enlarged view of the encircled portion IV of FIG. 3.
Figure 5:
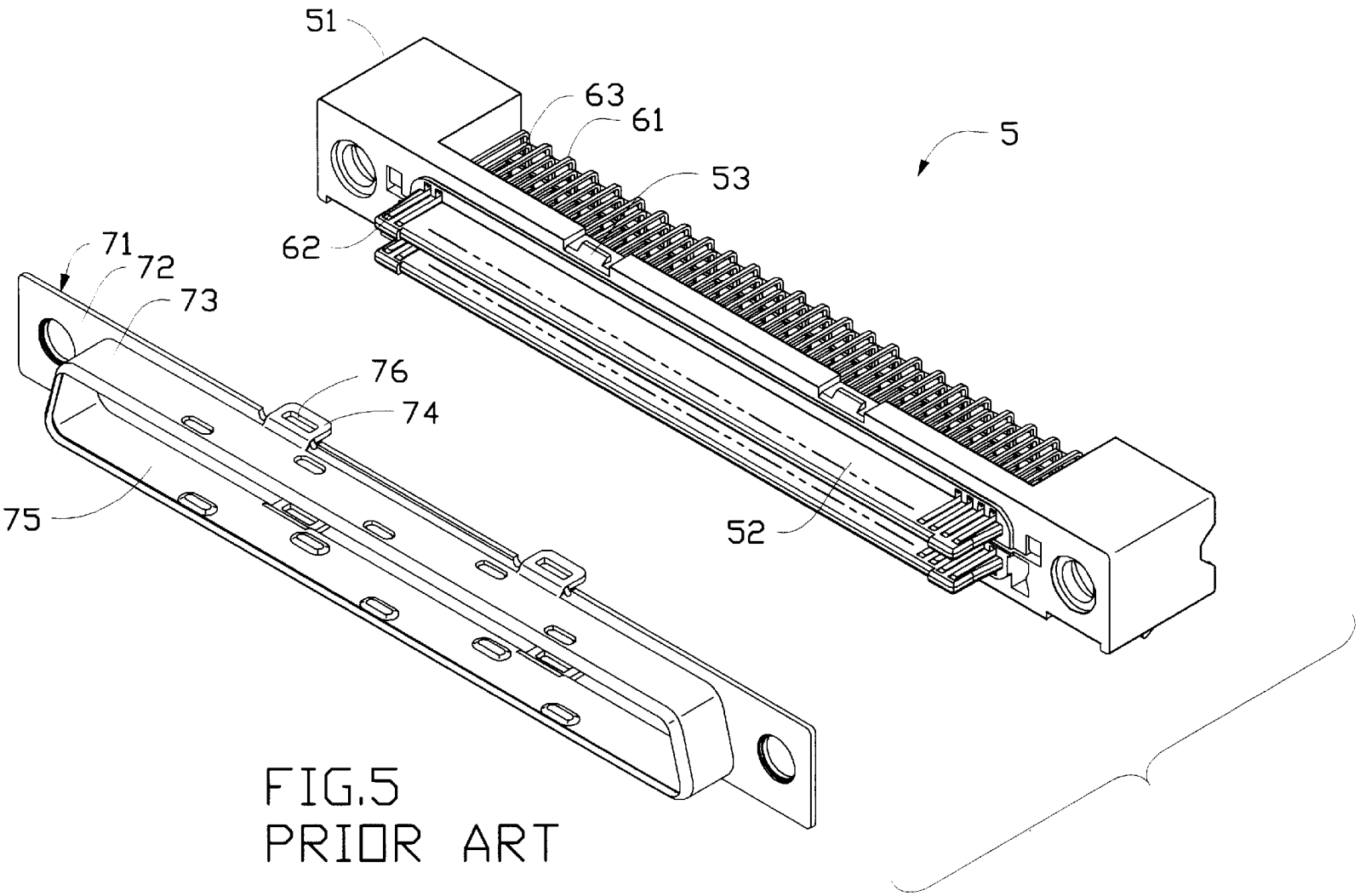
FIG.5 PRIOR ART
FIG. 5 is an exploded view of a conventional electrical connector.

The second securing means 161 comprises a protrusion 163 having an expanded end 164 corresponding to the notch 43 and retained therein by the neck 430. Preferably, the second securing means 161 comprises a recess 162 defined in the housing 10 in communication with the slot 16 and the protrusion 163 extends into the recess 162. The recess 162 receives the projections 42 of the corresponding first securing means 41 with the protrusion 163 fit into the notch 43 (FIG. 4) whereby the edge 48 of the plate 49 is stably received and retained in the slot 16 of the housing 10.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

an insulative housing having a front face, an opposite rear face and two end blocks, a plurality of passageways defined between the front face and the rear face for receiving and retaining contact elements, the end blocks having inner faces defining a space therebetween together with the rear face of the housing, each contact element having a mating section extending beyond the front face and a tail section extending beyond the rear face and being positioned in the space;

a front shielding member attached to the front face of the housing and comprising a tubular section surrounding and shielding the mating sections of the contact elements; and a rear shielding member attached to the rear face of the housing and shielding the tail sections of the contact elements, the rear shielding member comprising a plate received in the space to substantially cover the tail sections of the contact elements; wherein a slot is defined in the housing extending along the inner faces of the end blocks and the rear face of the housing so as to receive and retain a peripheral edge of the plate of the rear shielding member.

2. The electrical connector as claimed in claim 1, wherein first securing means is provided on the rear shielding member and second securing means is provided on the housing, the first securing means and the second securing means being engageable with each other for securing the rear shielding member to the housing.

3. The electrical connector as claimed in claim 2, wherein the first securing means comprises notches formed in the peripheral edge and the second securing means comprises protrusions corresponding to the notches and having expanded ends fittingly received in the notches.

4. The electrical connector as claimed in claim 3, wherein each notch has two side projections having inclined inner faces opposing and diverging away from each other to define a neck between the inner faces and the notch which retains the expanded end of the corresponding protrusion therein.

5. The electrical connector as claimed in claim 4, wherein recesses are defined in the housing for receiving the side projections of the notches of the first securing means.

* * * * *